US011207230B2

(12) United States Patent
Park

(10) Patent No.: US 11,207,230 B2
(45) Date of Patent: Dec. 28, 2021

(54) PATIENT BED SYSTEM INCLUDING DEFECATION DEVICE HAVING IMPROVED PIPING STRUCTURE

(71) Applicant: MOTHER'S HANDS, Dangjin-si (KR)

(72) Inventor: Chan Ho Park, Seoul (KR)

(73) Assignee: MOTHER'S HANDS, Dangjin-si (KR)

( * ) Notice: Subject to any disclaimer, the term of this patent is extended or adjusted under 35 U.S.C. 154(b) by 162 days.

(21) Appl. No.: 16/491,557

(22) PCT Filed: Jun. 23, 2017

(86) PCT No.: PCT/KR2017/006641
§ 371 (c)(1),
(2) Date: Sep. 5, 2019

(87) PCT Pub. No.: WO2018/164319
PCT Pub. Date: Sep. 13, 2018

(65) Prior Publication Data

US 2020/0030168 A1 Jan. 30, 2020

(30) Foreign Application Priority Data

Mar. 9, 2017 (KR) ..... 10-2017-0030292

(51) Int. Cl.
*A61G 7/02* (2006.01)
*A61G 7/00* (2006.01)
*A61G 7/015* (2006.01)

(52) U.S. Cl.
CPC ..... *A61G 7/02* (2013.01); *A61G 7/0005* (2013.01); *A61G 7/015* (2013.01)

(58) Field of Classification Search
CPC ..... A61G 7/047; A61G 7/02; A61G 7/002; A61G 7/015; A47C 19/22
See application file for complete search history.

(56) References Cited

FOREIGN PATENT DOCUMENTS

| | | | |
|---|---|---|---|
| KR | 1020080029590 | A | 4/2008 |
| KR | 1020110122539 | A | 11/2011 |
| KR | 1020120078544 | A | 7/2012 |
| KR | 1020120139242 | A | 12/2012 |
| KR | 1020160000654 | A | 1/2016 |

OTHER PUBLICATIONS

International Search Report of PCT/KR2017/006641, dated Dec. 6, 2017, English translation.

*Primary Examiner* — David R Hare
*Assistant Examiner* — Adam C Ortiz
(74) *Attorney, Agent, or Firm* — STIP Law Group, LLC

(57) ABSTRACT

According to a patient bed system including a defecation device having an improved piping structure, presented in the present invention, a defecation device is integrally provided in a patient bed, an excrement discharge pipe communicating with a discharge hole at the lower part of a bedpan body is formed by a roundedly inclined piping structure in which excrement flows down by its own weight, an opened end of the excrement discharge pipe can be opened and closed in order to discharge excrement by means of the simple operation of a handle part including an opening and closing member, and an excrement collection polybag in which excrement collection plastic is embedded so as to be discharged in order to facilitate the collection of excrement discharged by a patient is formed so as to be fastened to the excrement discharge pipe, such that, compared with a conventional excrement device, the present invention facilitates cleaning and can increase the convenience of simple operation with one hand.

8 Claims, 14 Drawing Sheets

PATIENT BED SYSTEM INCLUDING DEFECATION DEVICE HAVING IMPROVED PIPING STRUCTURE

CROSS-REFERENCE TO RELATED APPLICATIONS

This application is the U.S. National Phase under 35 U.S.C. § 371 of International Application No. PCT/KR2017/006641 filed on Jun. 23, 2017, which in turn claims the benefit of Korean Application No. 10-2017-0030292, filed on Mar. 9, 2017, the disclosures of which are incorporated by reference into the present application.

TECHNICAL FIELD

The present invention relates generally to a patient bed system including a defecation device having an improved piping structure and, more particularly, to a patient bed system including a defecation device having an improved piping structure, in which a patient bed is configured to allow critical patients and dementia patients, who have difficulty in moving and cannot handle their excrement themselves, to egest in a lying or sitting position, and allow a patient having difficulty in moving to smoothly move to a wheelchair or to the bed, and it is possible to facilitate cleaning while excrement is handled cleanly and hygienically without generating odor.

BACKGROUND ART

In general, hospitals and nursing facilities, etc. provide patient beds that can be used by the elderly and patients having difficulty in moving in a lying or sitting position. Such a patient bed is configured such that a patient's upper body is raised by adjusting the angle of a back rest so that the back rest of the bed is directed vertically, or the patient's upper body is laid down by adjusting the angle of the back rest so that the back rest of the bed is directed horizontally depending on the purpose of use such as sleeping, reading or eating. Herein, the patient bed is problematic in that a patient who has difficulty in moving may not move by his or herself in order to defecate. Thus, a patient who has difficulty in moving on the patient bed requires assistance of a caregiver, nurse, or guardian in order to egest such as urine and feces.

As described above, to solve the defecation of a patient having difficulty in moving, the patient moves to a toilet by using a wheelchair with assistance of a caregiver or guardian, or a portable toilet is provided and is positioned under the bed when the patient defecates. In other words, in order to egest such as urine and feces, the need for caregivers or guardians was always desperately required, and there was an uncomfortable problem that the caregivers or guardians should always wait around the patient. Further, there was a problem that odor occurred when using a portable toilet. Further, in the case of the elderly or serious patients who are difficult to control excrement such as urine and feces, it is difficult to withstand the moving time to the toilet or the installation time of the portable toilet, thereby causing problems such as defecation while wearing underwear and the like.

As described above, it is very difficult for a caregiver or a guardian to handle excrement such as urine and feces of a patient who has difficulty in moving due to partial anesthesia or paralysis because of surgery or the like, and there was a problem that the patient may feel shame by exposing the patient's important areas for defecation. In other words, in order to defecate such as urine and feces, the patient is required to show the patient's important areas to a caregiver or a guardian, and thus, not only may the patient be psychologically burdened, but the caregiver or guardian may be also burdened.

To solve these problems, there has been proposed a patient diaper for hygienic handling and treatment of patient's excrement such as urine and feces, but when the patient diaper is removed after use, the patient may feel shame due to removal of excrement on the buttocks of the patient with tissues or towels. Further, repetitive use of patient diaper may result in damage to the skin of vulnerable parts such as the patient's buttocks, and may result in eczema and pressure ulcers. Also, the patient diaper is made of a disposable synthetic material, resulting in a large amount of waste due to patient diapers discarded after use, and the disposal and incineration of the patient diaper releases carbon dioxide (CO2), which causes environmental pollution. Further, repetitive use of the patient diaper increases the economic burden on the patient. To solve these problems, Korean Patent No. 10-1592963 (patient bed system) has been disclosed as a related art document, which is a patented invention applied by the applicant of the present invention.

The applicant of the present invention intends to propose a structure that can solve the problems that it is difficult to clean excrement and foreign substances in the excrement remain at a connection part due to a conventional piping structure of an excrement device using a ball valve, arising from the related art registered by the applicant.

DISCLOSURE

Technical Problem

Accordingly, an object of the present invention is intended to propose a patient bed system including a defecation device having an improved piping structure, in which a defecation device is integrally provided in a patient bed, wherein an excrement discharge pipe communicating with a discharge hole at the lower portion of a bedpan body is formed in a curvedly inclined piping structure such that excrement flows down by a weight thereof; an open end portion of the excrement discharge pipe can be opened and closed to discharge the excrement by a simple operation of a handle part having an opening and closing member; and an excrement collection polybag, which is provided with an excrement collection plastic therein to be discharged in order to facilitate collection of the excrement discharged by the patient, is fastened to the excrement discharge pipe, whereby compared with a conventional excrement device, the present invention facilitates cleaning and can increase the operational convenience with one hand.

Further, another object of the present invention is intended to propose a patient bed system including a defecation device having an improved piping structure, in which critical patients and dementia patients, who have difficulty in moving and cannot handle their excrement themselves, can easily handle their own urine and feces without assistance of a caregiver, nurse or guardian, and also, it is possible to process the excrement of the patient quickly and hygienically, and is possible to smoothly move the patient, who has difficulty in moving, to a wheelchair or to the bed by using a rotatable plate of a patient moving device Technical Solution To achieve the above objects, there is provided a patient bed system including a defecation device having an improved piping structure according to the present invention, the patient bed system including:

a patient bed including: a frame-structured bed frame including an angle-adjustable back rest portion, a hip rest portion connected to the back rest portion, and a leg rest portion to which an angle-adjustable foot rest portion is connected; and a mattress provided with a back rest mat, a hip rest mat, a foot rest mat, and a leg rest mat to cover the back rest portion, the hip rest portion, the foot rest portion, and the leg rest portion of the bed frame, respectively; and a defecation device provided on the hip rest portion of the bed frame of the patient bed, and configured to allow a patient to handle after defecation in a lying or sitting position, wherein the defecation device includes:

a bedpan body provided with a discharge hole to discharge excrement of the patient;

an excrement discharge pipe communicating with the discharge hole at a lower portion of the bedpan body, and allowing excrement of the patient to flow down along with washing water through the discharge hole of the bedpan body;

a connecting member including: a reverse L shaped connecting body being configured such that a first end thereof is fixedly provided at a middle portion of the excrement discharge pipe and a second end thereof is bent and disposed parallel to an end portion of the excrement discharge pipe; a short insertion portion formed horizontally at an inner side of the connecting body; a connecting screw fastened to an end portion of the connecting body; and an oblong fastening hole formed in an upper end portion of the connecting body;

a handle part including: a handle operating rod connected to the upper end portion of the connecting body of the connecting member via a connecting main body fixed by screwing with the oblong fastening hole; and a handle interlocking rod fixedly provided to have a predetermined angle to be operated in conjunction with the handle operating rod, and provided with an opening and closing member to open and close an open end portion of the excrement discharge pipe; and an excrement collection polybag formed in a double tubular shape having an excrement collection plastic therein for easy collection of the excrement of the patient, and configured such that a hollow portion therein is inserted in the form of receiving the excrement discharge pipe, then a rear outer tube is inserted into the insertion portion provided in the connecting body, and a guide coupling member protruding on a front outer tube is fixedly fastened to the connecting screw.

Preferably, the excrement discharge pipe may be configured in a trumpet shape having a curvedly inclined piping structure at the lower portion of the bedpan body (210) such that the excrement of the patient flows down by a weight thereof along with the washing water.

Preferably, the handle part may be configured such that:

the handle interlocking rod is formed in a facing guide bar shape that variably adjusts an installation position of the opening and closing member; and the opening and closing member is formed in a disk shape for sealing the open end portion of the excrement discharge pipe, and is provided with a fastening member at a center of the opening and closing member to be fastened to the handle interlocking rod, and a sealing member at a position brought in contact with the open end portion of the excrement discharge pipe for hermetic sealing.

Preferably, the excrement collection polybag may be formed in the double tubular shape with a sealed front end and an open rear end, may be configured such that a length of the outer tube being open at a rear end thereof is longer than a length of an inner tube, and may be further provided with a circular tube at the sealed front end of the hollow portion to be brought in contact with the excrement collection plastic discharged in a form of wrapping around the excrement discharge pipe, thereby preventing smell of the excrement of the patient from flowing back into a room.

More preferably, the patient bed may further include a hair wash basin provided in the back rest portion of the bed frame to allow the patient to wash his/her own hair in a lying position, wherein the hair wash basin provided in the back rest portion is exposed for use when an upper back rest mat of the back rest mat provided to cover the back rest portion is folded toward a lower back rest mat.

Even more preferably, the hair wash basin may be configured in any one shape of a box shape with an upper portion being open, and a hopper shape with a piping connected thereto.

Even more preferably, the patient bed system may further include a water supply device provided at a lower portion of the bed frame of the patient bed to supply washing water to a plastic container for storing the washing water, an underwater pump for supplying the washing water stored in the plastic container, and a pipe connected through the underwater pump;

a shower provided at a side of the patient bed to allow the patient to use the washing water supplied from the water supply device;

a motorized patient moving device including: a rotatable plate provided at a center of the foot rest portion and provided with a toothed gear at a center lower surface thereof; a shaft gear connected to the toothed gear of the rotatable plate; and a reducer connected to the shaft gear, wherein the motorized patient moving device is configured such that the rotatable plate is automatically rotated while the toothed gear engaged with the shaft gear is rotated by driving of the reducer under control of a controller; and the controller for controlling driving of the bed frame, the defecation device, the water supply device, and the patient moving device.

Even more preferably, the patient bed system may further include a leg plate openably provided by a hinge at an end portion of the bed frame, in which the foot rest portion is provided, wherein the leg plate is provided with a locking device having a hook and an eye to prevent the leg plate to be unintentionally opened.

Advantageous Effects

According to the patient bed system including a defecation device having an improved piping structure proposed in the present invention, the defecation device is integrally provided in the patient bed, wherein the excrement discharge pipe communicating with the discharge hole at the lower portion of the bedpan body is formed in a curvedly inclined piping structure such that the excrement flows down by a weight thereof; the open end portion of the excrement discharge pipe can be opened and closed to discharge the excrement by a simple operation of the handle part having the opening and closing member; and the excrement collection polybag, which is provided with the excrement collection plastic therein to be discharged in order to facilitate collection of the excrement discharged by the patient, is fastened to the excrement discharge pipe, whereby compared with a conventional excrement device, the present invention facilitates cleaning and can increase the operational convenience with one hand.

Further, according to the present invention, critical patients and dementia patients, who have difficulty in moving and cannot handle their excrement by themselves, can easily handle urine and feces thereof without assistance of a caregiver, nurse or guardian, and also, it is possible to process the excrement of the patient quickly and hygienically, and is possible to smoothly move the patient, who has difficulty in moving, to the wheelchair or to the bed by using the rotatable plate of the patient moving device.

DESCRIPTION OF REFERENCE CHARACTERS OF IMPORTANT PARTS

Figure 1:
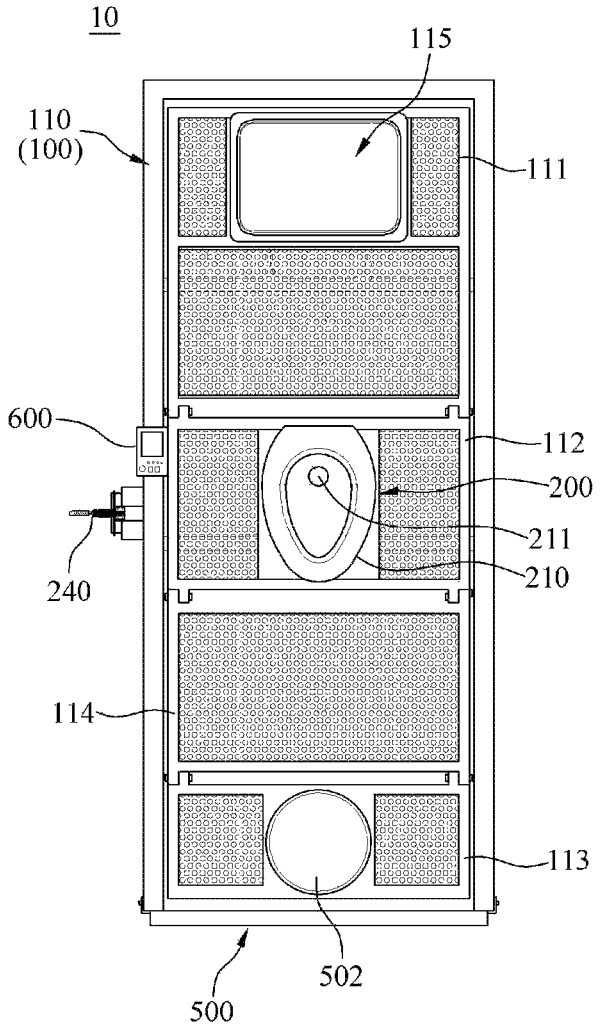
FIG. 1 shows a plan view of a bed system including a defecation device having an improved piping structure according to an embodiment of the present invention patient.

10: patient bed system according to embodiment of the present invention
100: patient bed
110: bed frame
111: back rest portion
112: hip rest portion
113: foot rest portion
114: leg rest portion
115: hair wash basin
120: mattress
121: back rest mat
121*a*: upper back rest mat
121*b*: lower back rest mat
122: hip rest mat
123: foot rest mat
124: leg rest mat
200: defecation device
210: bedpan body
211: discharge hole
220: excrement discharge pipe
230: connecting member
231: connecting body
232: insertion portion
233: connecting screw
234: fastening hole
240: handle part
241: connecting body
242: handle operating rod
243: opening and closing member
243*a*: fastening member
243*b*: sealing member
244: handle interlocking rod
250: excrement collection polybag
251: excrement collection plastic
252: guide coupling member
253: circular tube
300: water supply device
301: plastic container
302: underwater pump
303: pipe
400: shower
500: patient moving device
501: toothed gear
502: rotatable plate
503: shaft gear
504: reducer
600: controller (operation panel)
700: leg plate
701: hook
702: eye

BEST MODE

Hereinbelow, to aid to understanding the invention, preferred embodiments of the present invention will be described in detail with reference to the accompanying drawings. In the following description, it is to be noted that, when the functions of conventional elements and the detailed description of elements related with the present invention may make the gist of the present invention unclear, a detailed description of those elements will be omitted.

Wherever possible, the same reference numerals will be used throughout the drawings and the description to refer to the same or like elements or parts.

It will be understood that when an element is referred to as being "coupled" or "connected" to another element, it can be directly coupled or connected to the other element or intervening elements may be present therebetween. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof.

Figure 2:
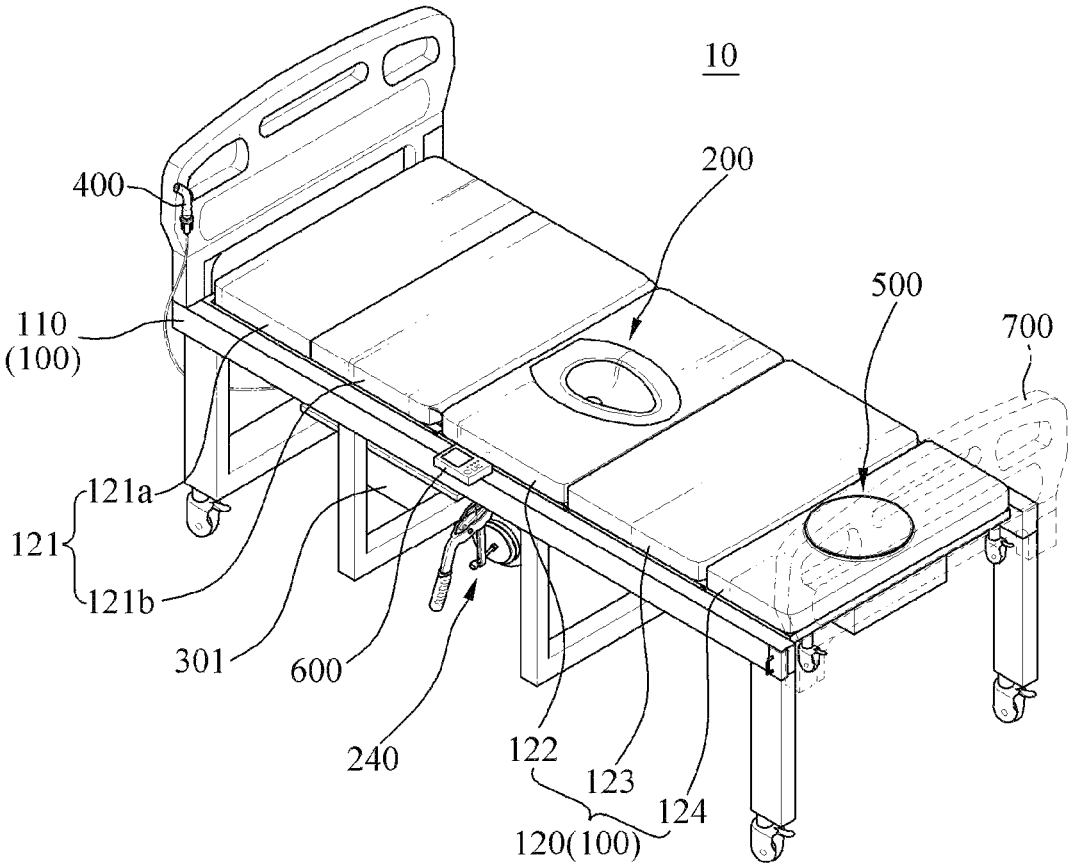
FIG. 2 shows a perspective view of the patient bed system including a defecation device having an improved piping structure according to an embodiment of the present invention.
Figure 3:
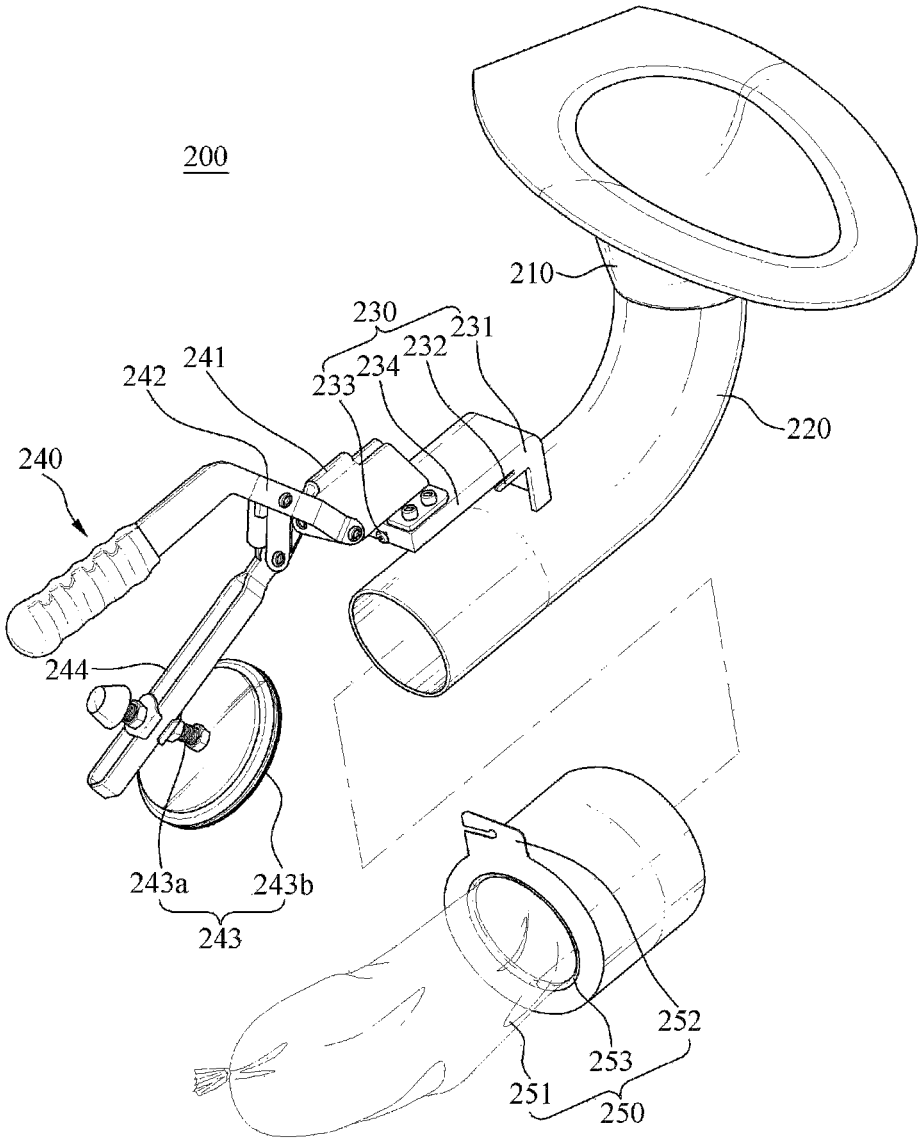
FIG. 3 shows a disassembled perspective view of a defecation device applied to the patient bed system including a defecation device having an improved piping structure according to an embodiment of the present invention.
Figure 4:
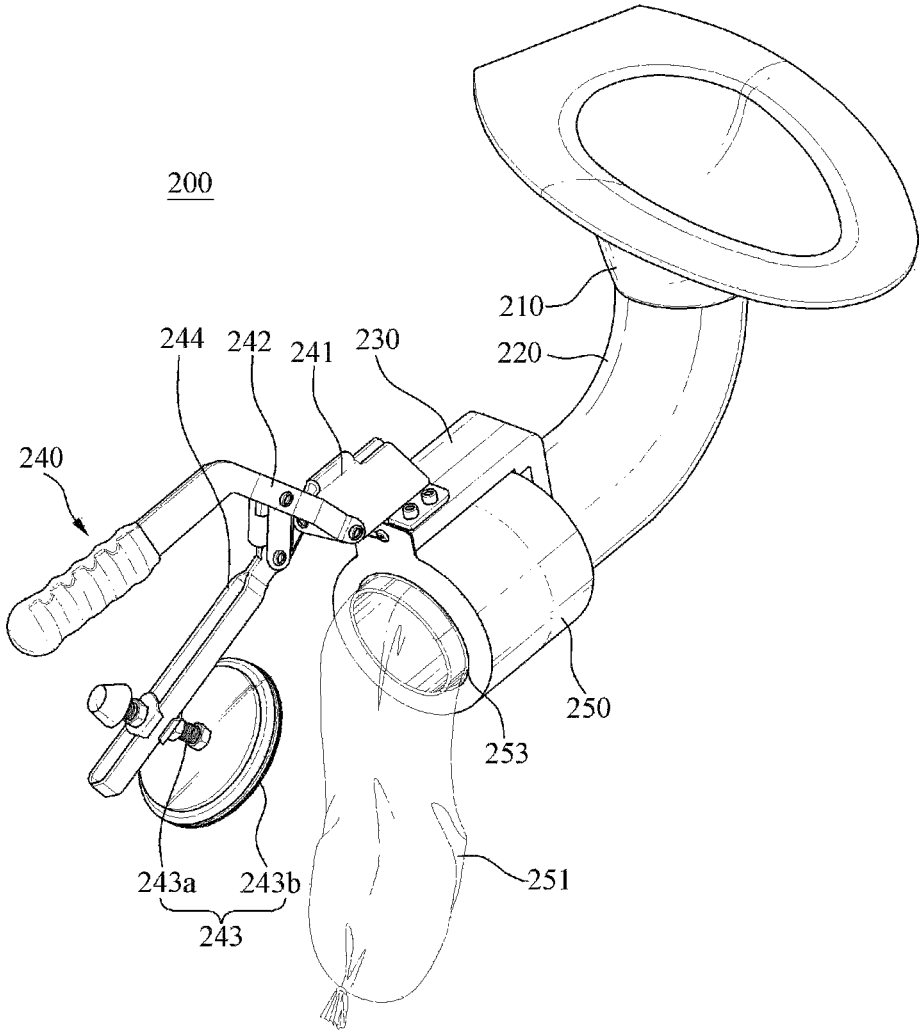
FIG. 4 shows an assembled perspective view of the defecation device applied to the patient bed system including a defecation device having an improved piping structure according to an embodiment of the present invention.
Figure 5A:
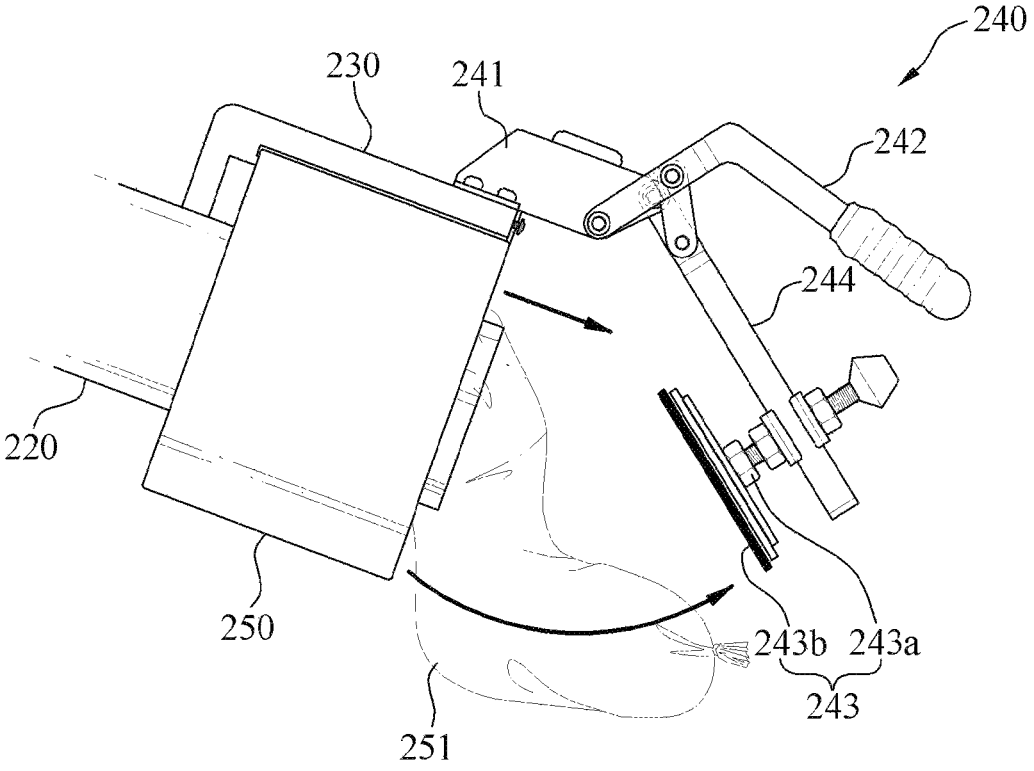
FIG. 5A and FIG. 5B shows views of the operation process of the defecation device applied to the patient bed system including a defecation device having an improved piping structure according to an embodiment of the present invention.
Figure 5B:
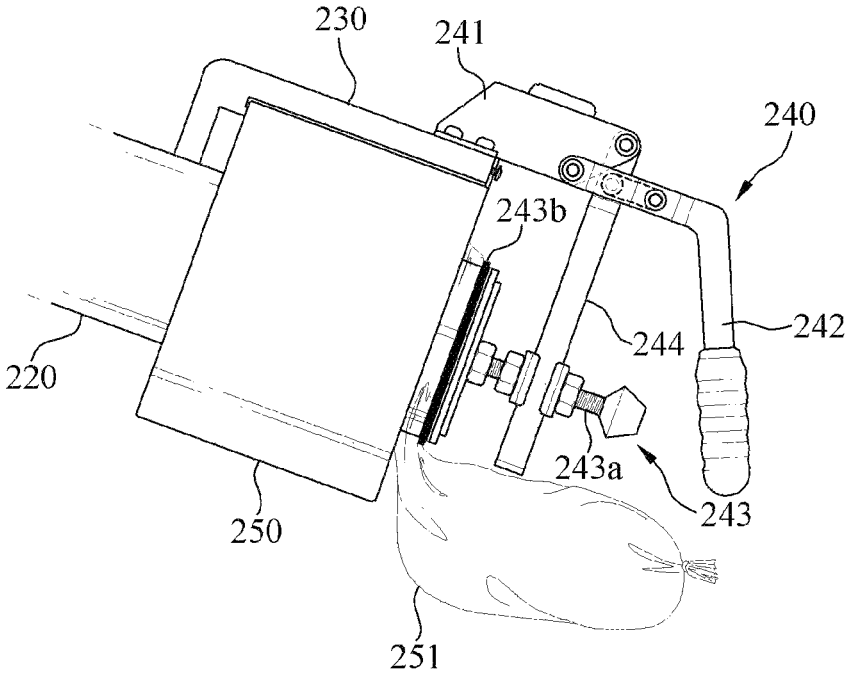
Figure 6:
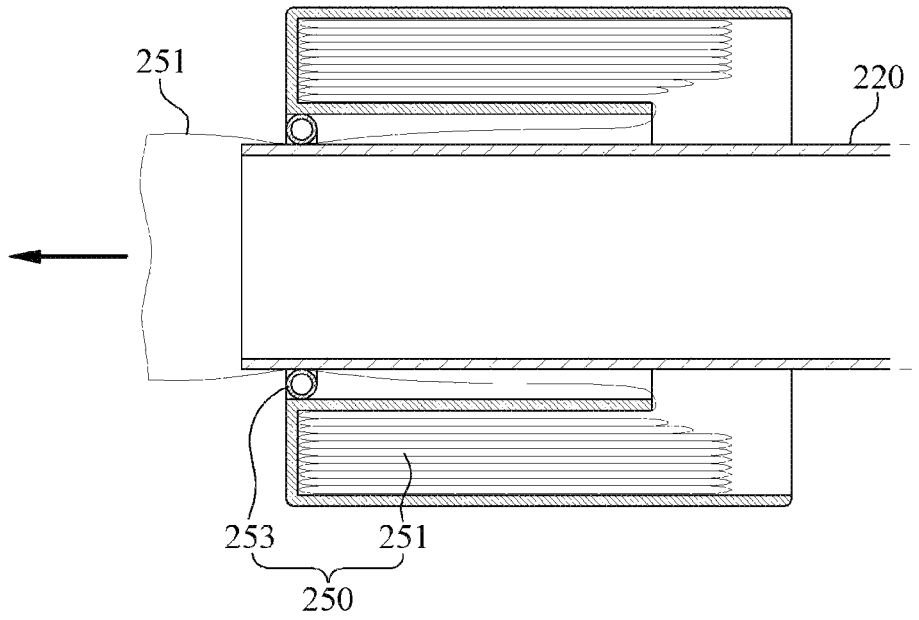
FIG. 6 shows a sectional view of the coupling state between an excrement discharge pipe and an excrement collection polybag applied to the patient bed system including a defecation device having an improved piping structure according to an embodiment of the present invention.
Figure 7A:
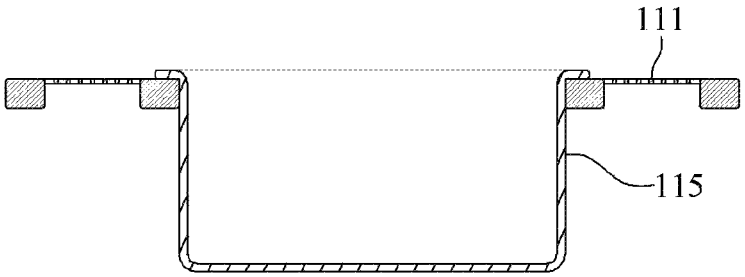
FIG. 7A and FIG. 7B shows views of examples of a hair wash basin disposed in a back rest portion of the patient bed system including a defecation device having an improved piping structure according to an embodiment of the present invention.
Figure 7B:
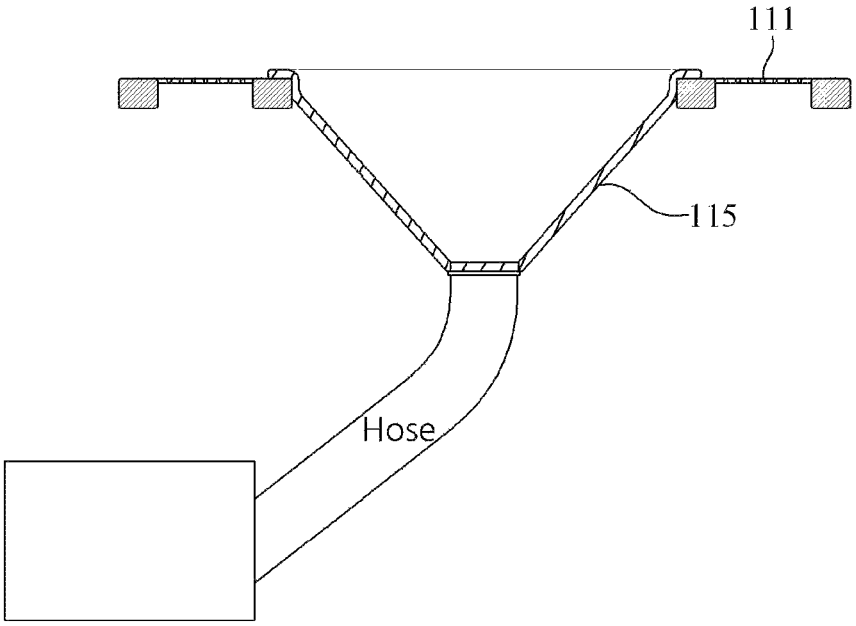
Figure 8:
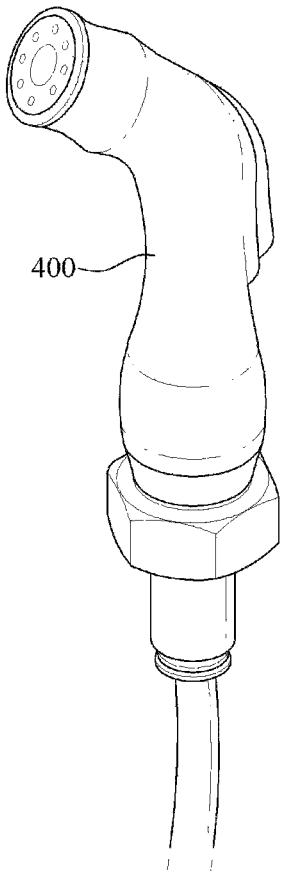
FIG. 8 shows a view of a shower applied to the patient bed system including a defecation device having an improved piping structure according to an embodiment of the present invention.
Figure 9:
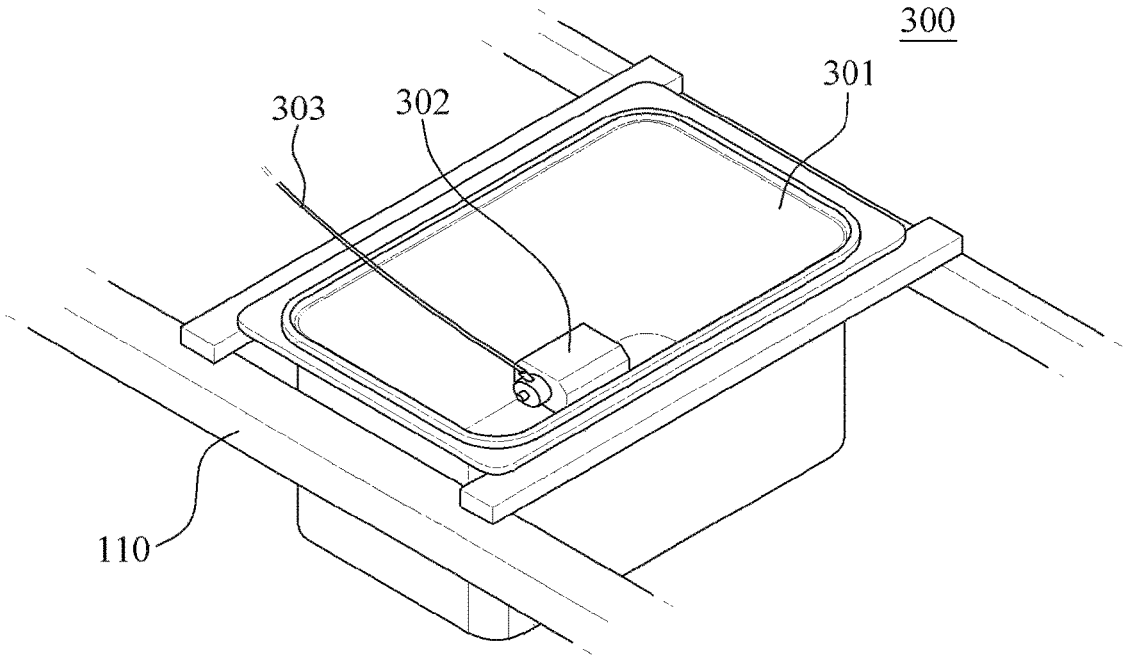
FIG. 9 shows a view of a water supply device applied to the patient bed system including a defecation device having an improved piping structure according to an embodiment of the present invention.

FIG. 1 shows a plan view of a bed system including a defecation device having an improved piping structure according to an embodiment of the present invention patient, FIG. 2 shows a perspective view of the patient bed system including a defecation device having an improved piping structure according to an embodiment of the present invention, FIG. 3 shows a disassembled perspective view of a defecation device applied to the patient bed system including a defecation device having an improved piping structure according to an embodiment of the present invention, FIG. 4 shows an assembled perspective view of the defecation device applied to the patient bed system including a defecation device having an improved piping structure according to an embodiment of the present invention, FIG. 5 shows views of the operation process of the defecation device applied to the patient bed system including a defecation device having an improved piping structure according to an embodiment of the present invention, FIG. 6 shows a sectional view of the coupling state between an excrement discharge pipe and an excrement collection polybag applied to the patient bed system including a defecation device having an improved piping structure according to an embodiment of the present invention, FIG. 7 shows views of examples of a hair wash basin disposed in a back rest portion of the patient bed system including a defecation device having an improved piping structure according to an embodiment of the present invention, FIG. 8 shows a view of a shower applied to the patient bed system including a defecation device having an improved piping structure according to an embodiment of the present invention, and FIG. 9 shows a view of a water supply device applied to the patient bed system including a defecation device having an improved piping structure according to an embodiment of the present invention. As shown in FIGS. 1 to 9, a patient bed system 10 including a defecation device having an improved piping structure according to an embodiment of the present invention may include a patient bed 100, and a defecation device 200, and may further include a water supply device 300, a shower 400, a patient moving device 500, a controller 600, and a leg plate 700.

The patient bed 100 may include: a frame-structured bed frame 110 including an angle-adjustable back rest portion 111, a hip rest portion 112 connected to the back rest portion 111, and a leg rest portion 114 to which an angle-adjustable foot rest portion 113 is connected; and a mattress 120 provided with a back rest mat 121, a hip rest mat 122, a foot rest mat 123, and a leg rest mat 124 to cover the back rest portion 111, the hip rest portion 112, the foot rest portion 113, and the leg rest portion 114 of the bed frame 110, respectively. The patient bed 100 may further include a hair wash basin 115 provided in the back rest portion 111 of the bed frame 110 to allow the patient to wash their hair in a lying position, wherein the hair wash basin 115 provided in the back rest portion 111 is exposed for use when an upper back rest mat 121*a* of the back rest mat 121 provided to cover the back rest portion 111 is folded toward a lower back rest mat 121*b*. Herein, the hair wash basin 115 may be configured, as shown in FIG. 7, in any one shape of a box shape with an upper portion being open, and a hopper shape with a piping connected thereto. In other words, FIG. 7*a* shows the box-shaped hair wash basin 115 provided in the back rest portion 111, and FIG. 7*b* shows the hopper-shaped hair wash basin 115, to which a drain hose is connected, provided in the back rest portion 111. The hopper-shaped hair wash basin 115 is connected via a hose to drain, and allows the used water to be drained through an outer container. Further, the bed frame 110 may be configured in a ⊏ shape, in which the back rest portion 111, the hip rest portion 112, and the leg rest portion 114 with the foot rest portion 113 connected thereto are connected together.

The defecation device 200 is provided on the hip rest portion 112 of the bed frame 110 of the patient bed 100, and allows the patient to handle after defecation in a lying or sitting position. As shown in FIGS. 3 to 5, the defecation device 200 may include: a bedpan body 210 provided with a discharge hole 211 to discharge excrement of the patient; an excrement discharge pipe 220 communicating with the discharge hole 211 at a lower portion of the bedpan body 210, and allowing excrement of the patient to flow down along with washing water through the discharge hole 211 of the bedpan body 210; a connecting member 230 including: a reverse L shaped connecting body 231 being configured such that a first end thereof is fixedly provided at a middle portion of the excrement discharge pipe 220 and a second end thereof is bent and disposed parallel to an end portion of the excrement discharge pipe 220; a short insertion portion 232 formed horizontally at an inner side of the connecting body 231; a connecting screw 233 fastened to an end portion of the connecting body 231; and an oblong fastening hole 234 formed in an upper end portion of the connecting body 231; a handle part 240 including: a handle operating rod 242 connected to the upper end portion of the connecting body 231 of the connecting member 230 via a connecting main body 241 fixed by screwing with the oblong fastening hole 234; and a handle interlocking rod 244 fixedly provided to have a predetermined angle to be operated in conjunction with the handle operating rod 242, and provided with an opening and closing member 243 to open and close an open end portion of the excrement discharge pipe 220; and an excrement collection polybag 250 formed in a double tubular shape having an excrement collection plastic 251 therein for easy collection of the excrement of the patient, and configured such that a hollow portion therein is inserted in the form of receiving the excrement discharge pipe 220, then a rear outer tube is inserted into the insertion portion 232 provided in the connecting body 231, and a guide coupling member 252 protruding on a front outer tube is fixedly fastened to the connecting screw 233.

Further, the excrement discharge pipe 220 may be configured in a trumpet shape having a curvedly inclined piping structure at the lower portion of the bedpan body 210 such that the excrement of the patient flows down by a weight thereof along with the washing water.

Further, the handle part 240 may be configured such that: the handle interlocking rod 244 is formed in a facing guide bar shape that variably adjusts an installation position of the opening and closing member 243; and the opening and closing member 243 is formed in a disk shape for sealing the open end portion of the excrement discharge pipe 220, and may be provided with a fastening member 243*a* at a center of the opening and closing member to be fastened to the handle interlocking rod 244, and a sealing member 243*b* at a position brought in contact with the open end portion of the excrement discharge pipe 220 for hermetic sealing.

Further, as shown in FIG. 6, the excrement collection polybag 250 may be formed in the double tubular shape with a sealed front end and an open rear end, is configured such that a length of the outer tube being open at a rear end thereof is longer than a length of an inner tube, and may be further provided with a circular tube 253 at the sealed front end of the hollow portion to be brought in contact with the excrement collection plastic 251 discharged in a form of wrapping around the excrement discharge pipe 220, thereby preventing smell of the excrement of the patient from flowing back into a room.

As shown in FIG. 9, the water supply device 300 is provided at a lower portion of the bed frame 110 of the patient bed 100 to supply washing water to a plastic container 301 for storing the washing water, an underwater pump 302 for supplying the washing water stored in the plastic container 301, and a pipe connected through the underwater pump 302. The water supply device 300 may supply washing water through the shower 400 and the bedpan body 210 of the defecation device 200, which will be described later.

The shower 400 is provided at a side of the patient bed 100 to allow the patient to use the washing water supplied from the water supply device 300.

Figure 13:
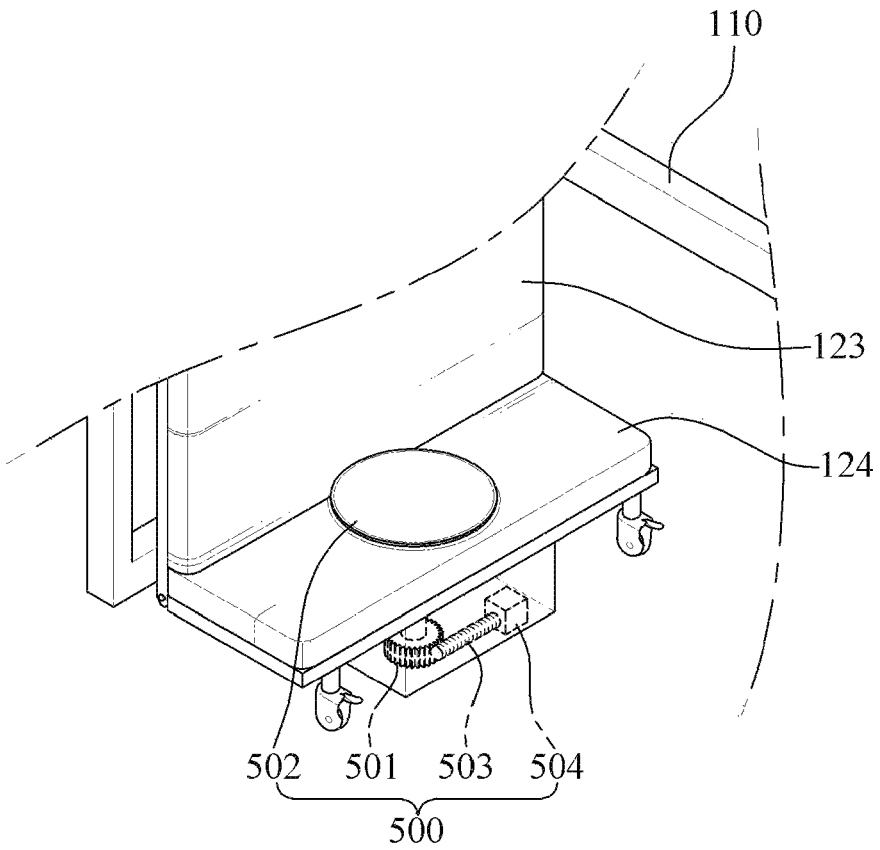
FIG. 13 shows a view of a motorized patient moving device applied to the patient bed system including a defecation device having an improved piping structure according to an embodiment of the present invention.

The patient moving device 500 is provided at an end of the bed frame 110 to move the patient for convenience of movement of patient. As shown in FIG. 13, the patient moving device 500 may be provided at a center of the foot rest portion 113, and may include: a rotatable plate 502 provided with a toothed gear 501 at a center lower surface thereof; a shaft gear 503 connected to the toothed gear 501 of the rotatable plate 502; and a reducer 504 connected to the shaft gear 503, and being configured to be motorized in such a way that the rotatable plate 502 is automatically rotated while the toothed gear 501 engaged with the shaft gear 503 is rotated by driving of the reducer 504 under control of a controller 600.

The controller 600 is for controlling driving of the bed frame 110, the defecation device 200, the water supply device 300, and the patient moving device 500. The controller 600 is provided in the patient bed system 10 to electronically control parts that need to be electronically controlled. Herein, the controller 600 may be configured in the form of a wired operation panel, but is not limited thereto, and may be configured as a wireless remote controller.

The leg plate 700 is openably provided by a hinge at an end portion of the bed frame 110, in which the foot rest portion 113 is provided. As shown in FIG. 13, the leg plate 700 may be provided with a locking device having a hook 701 and an eye 702 to prevent the leg plate to be unintentionally opened. Herein, the leg plate 700 is configured to be opened and closed to facilitate the movement of the patient when the patient moves from the bed frame 110 to a wheelchair (not shown) or moves from the wheelchair to the bed frame 110. Further, as shown in FIG. 13, the leg plate 700 is opened by rotation as an example, but is not limited thereto. A conventional structure, in which the leg plate 700 is separable upward, may be applied.

Figure 10:
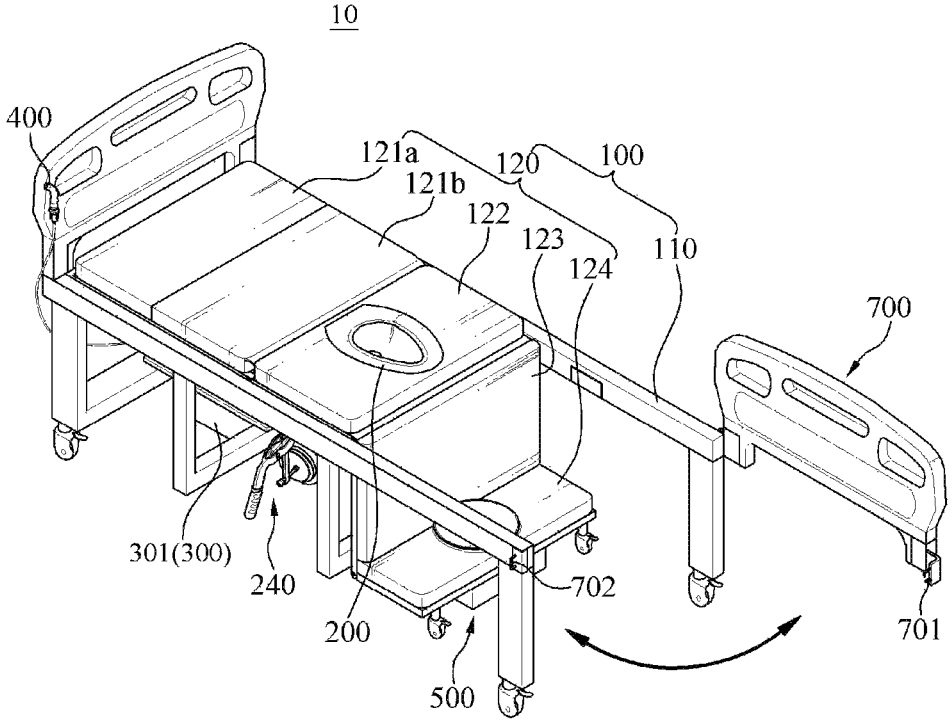
FIG. 10, FIG. 11 and FIG. 12 shows views of the moving process of a patient using the patient bed system including a defecation device having an improved piping structure according to an embodiment of the present invention.
Figure 11:
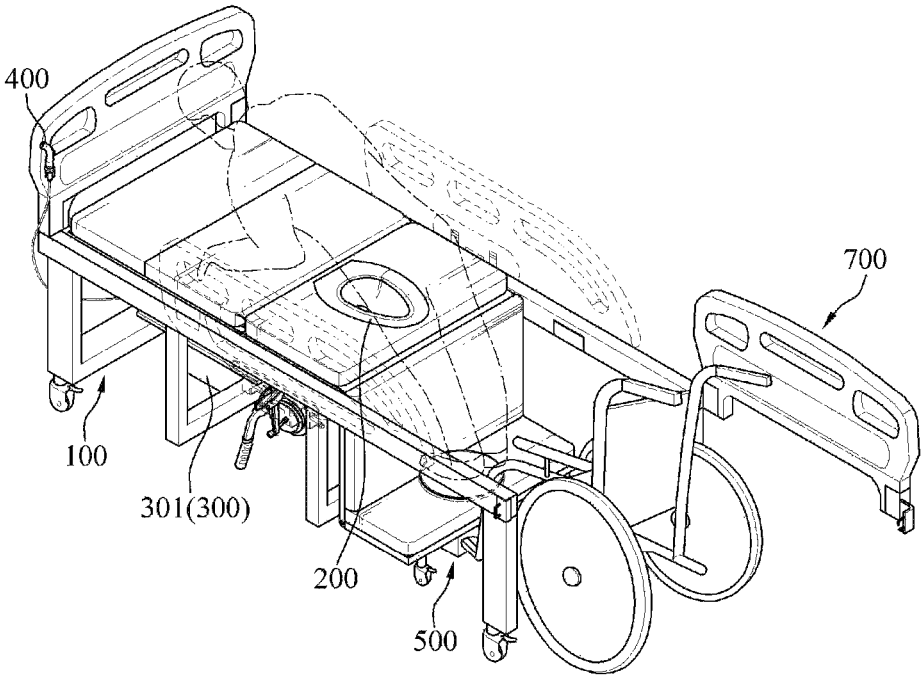
Figure 12:
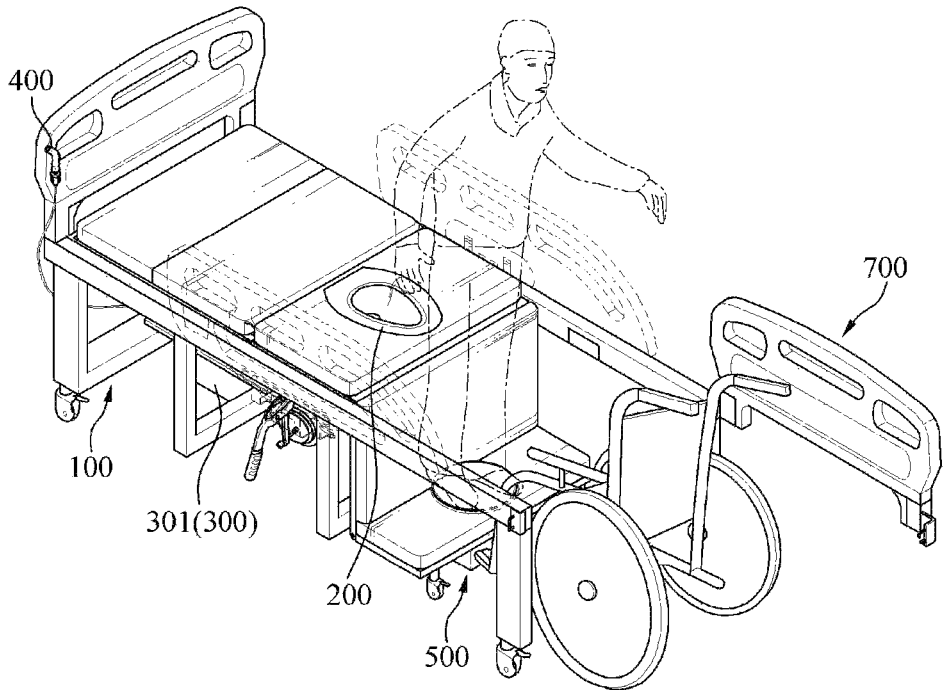

FIGS. 10 to 12 shows views of the moving process of a patient using the patient bed system including a defecation device having an improved piping structure according to an embodiment of the present invention. As shown in FIGS. 10 to 12, a patient, the elderly, or a critical patient, who has difficulty in moving and lives on the patient bed 100 of the patient bed system 10 according to the present invention, may manipulate and control a keypad of an operation panel of the controller 600 to adjust the angle of inclination of the back rest portion 111 and the leg rest portion 114 of the bed frame 110 of the patient bed 100 to convert the bed into a chair form. This allows the elderly or patient using the patient bed 100 to take a sitting position. Here, the locking device constituted by the hook 701 and the eye 702 is released to allow the end of the bed frame 110 to be opened and closed, and when the leg plate 700 is opened, the wheelchair for moving the patient is positioned inside the foot rest portion 113 of the leg rest portion 114 of the patient bed 100. As such, when the wheelchair is prepared and positioned, the patient, who is in a sitting position in the patient bed 100 converted into a chair, puts his or her feet on a rotatable plate 502 provided at the center of the foot rest portion 113 of the leg rest portion 114, then stands up while holding the left and right side frames of the patient bed 100 with both hands, and then is rotated by driving of the motorized patient moving device 500. This allows the patient's buttocks to be seated on the wheelchair seat from the patient bed 100, allowing movement through the wheelchair. In other words, the patient living on the patient bed 100 of the patient bed system 10 is allowed to move from the bed to the wheelchair through the patient moving device 500 by himself or herself, which enables the patient to move without the need of a caregiver, nurse, or guardian.

Further, after the use of the wheelchair is completed, as shown in FIG. 12, the wheelchair is positioned inside the foot rest portion 113 of the leg rest portion 114 of the patient bed 100 and positioned, and then in the state where the patient puts his or her feet on the rotatable plate 502 provided at the center of the foot rest portion 113 of the leg rest portion 114, the patient's buttocks is moved from the wheelchair to the bed by the motorized driving of the patient moving device 500 while the patient holds the left and right side frames of the patient bed 100 with both hands.

FIG. 13 shows a view of a motorized patient moving device applied to the patient bed system including a defecation device having an improved piping structure according to an embodiment of the present invention. As shown in FIG. 13, the patient moving device 500, which is a motorized rotating device that rotates for convenience of movement of patient, includes: the rotatable plate 502 provided at the center of the foot rest portion 113 and provided with a toothed gear 501 at a center lower surface thereof; a shaft gear 503 connected to the toothed gear 501 of the rotatable plate 502; and a reducer 504 connected to the shaft gear 503, wherein the motorized patient moving device is configured such that the rotatable plate 502 is automatically rotated while the toothed gear 501 engaged with the shaft gear 503 is rotated by driving of the reducer 504 under the control of the controller 600, as shown in FIGS. 10 to 12.

As described above, the patient bed system including a defecation device having an improved piping structure according to an embodiment of the present invention is configured such that the defecation device is integrally provided in the patient bed, wherein the excrement discharge pipe communicating with the discharge hole at the lower portion of the bedpan body is formed in a curvedly inclined piping structure such that the excrement flows down by a weight thereof; the open end portion of the excrement discharge pipe can be opened and closed to discharge the excrement by a simple operation of the handle part having the opening and closing member; and the excrement collection polybag, which is provided with the excrement collection plastic therein to be discharged in order to facilitate collection of the excrement discharged by the patient, is fastened to the excrement discharge pipe, whereby compared with a conventional excrement device, the present invention facilitates cleaning and can increase the operational convenience with one hand. Further, critical patients and dementia patients, who have difficulty in moving and cannot handle their excrement themselves, can easily handle urine and feces thereof without assistance of a caregiver, nurse or guardian. Also, it is possible to process the excrement of the patient quickly and hygienically, and is possible to smoothly move the patient, who has difficulty in moving, to the wheelchair or to the bed by using the rotatable plate of the patient moving device.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A patient bed system (10) including a defecation device having an improved piping structure, the patient bed system comprising:

a patient bed (100) including: a frame-structured bed frame (110) including an angle-adjustable back rest portion (111), a hip rest portion (112) connected to the back rest portion (111), and a leg rest portion (114) to which an angle-adjustable foot rest portion (113) is connected; and a mattress (120) provided with a back rest mat (121), a hip rest mat (122), a foot rest mat (123), and a leg rest mat (124) to cover the back rest portion (111), the hip rest portion (112), the foot rest portion (113), and the leg rest portion (114) of the bed frame (110), respectively; and a defecation device (200) provided on the hip rest portion (112) of the bed frame (110) of the patient bed (100), and configured to allow a patient to handle after defecation in a lying or sitting position, wherein the defecation device (200) includes:

a bedpan body (210) provided with a discharge hole (211) to discharge excrement of the patient;

an excrement discharge pipe (220) communicating with the discharge hole (211) at a lower portion of the bedpan body (210), and allowing excrement of the patient to flow down along with washing water through the discharge hole (211) of the bedpan body (210);

a connecting member (230) including: a reverse L shaped connecting body (231) being configured such that a first end thereof is fixedly provided at a middle portion of the excrement discharge pipe (220) and a second end thereof is bent and disposed parallel to an end portion of the excrement discharge pipe (220); a short insertion portion (232) formed horizontally at an inner side of the connecting body (231); a connecting screw (233) fastened to an end portion of the connecting body (231); and an oblong fastening hole (234) formed in an upper end portion of the connecting body (231);

a handle part (240) including: a handle operating rod (242) connected to the upper end portion of the connecting body (231) of the connecting member (230) via a connecting main body (241) fixed by screwing with the oblong fastening hole (234); and a handle interlocking rod (244) fixedly provided to have a predetermined angle to be operated in conjunction with the handle operating rod (242), and provided with an opening and closing member (243) to open and close an open end portion of the excrement discharge pipe (220); and an excrement collection polybag (250) formed in a double tubular shape having an excrement collection plastic (251) therein for easy collection of the excrement of the patient, and configured such that a hollow portion therein is inserted in the form of receiving the excrement discharge pipe (220), then a rear outer tube is inserted into the insertion portion (232) provided in the connecting body (231), and a guide coupling member (252) protruding on a front outer tube is fixedly fastened to the connecting screw (233).

2. The patient bed system of claim 1, wherein the excrement discharge pipe (220) is configured in a curvedly inclined piping structure at the lower portion of the bedpan body (210) such that the excrement of the patient flows down by a weight thereof along with the washing water.

3. The patient bed system of claim 1, wherein the handle part (240) is configured such that: the handle interlocking rod (244) is formed in a facing guide bar shape that variably adjusts an installation position of the opening and closing member (243); and the opening and closing member (243) is formed in a disk shape for sealing the open end portion of the excrement discharge pipe (220), and is provided with a fastening member (243*a*) at a center of the opening and closing member to be fastened to the handle interlocking rod (244), and a sealing member (243*b*) at a position brought in contact with the open end portion of the excrement discharge pipe (220) for hermetic sealing.

4. The patient bed system of claim 1, wherein the excrement collection polybag (250) is formed in the double tubular shape with a sealed front end and an open rear end, is configured such that a length of the outer tube being open at a rear end thereof is longer than a length of an inner tube, and is further provided with a circular tube (253) at the sealed front end of the hollow portion to be brought in contact with the excrement collection plastic (251) discharged in a form of wrapping around the excrement discharge pipe (220), thereby preventing smell of the excrement of the patient from flowing back into a room.

5. The patient bed system of claim 4, wherein the patient bed (100) further includes a hair wash basin (115) provided in the back rest portion (111) of the bed frame (110) to allow the patient to wash his/her own hair in a lying position, wherein the hair wash basin (115) provided in the back rest portion (111) is exposed for use when an upper back rest mat (121*a*) of the back rest mat (121) provided to cover the back rest portion (111) is folded toward a lower back rest mat (121*b*).

6. The patient bed system of claim 5, wherein the hair wash basin (115) is configured in any one shape of a box shape with an upper portion being open, and a funnel shape with a piping connected thereto.

7. The patient bed system (10) of claim 6, further comprising:

a water supply device (300) provided at a lower portion of the bed frame (110) of the patient bed (100) to supply washing water to a plastic container (301) for storing the washing water, an underwater pump (302) for supplying the washing water stored in the plastic container (301), and a pipe connected through the underwater pump (302);

a shower (400) provided at a side of the patient bed (100) to allow the patient to use the washing water supplied from the water supply device (300);

a motorized patient moving device (500) including: a rotatable plate (502) provided at a center of the foot rest portion (113) and provided with a toothed gear (501) at a center lower surface thereof; a shaft gear (503) connected to the toothed gear (501) of the rotatable plate (502); and a reducer (504) connected to the shaft gear (503), wherein the motorized patient moving device is configured such that the rotatable plate (502) is automatically rotated while the toothed gear (501) engaged with the shaft gear (503) is rotated by driving of the reducer (504) under control of a controller (600); and the controller (600) for controlling driving of the bed frame (110), the defecation device (200), the water supply device (300), and the patient moving device (500).

8. The patient bed system of claim 7, further comprising:

a leg plate (700) openably provided by a hinge at an end portion of the bed frame (110), in which the foot rest portion (113) is provided, wherein the leg plate (700) is provided with a locking device having a hook (701) and an eye (702) to prevent the leg plate to be unintentionally opened.

* * * * *